US010604315B2

(12) United States Patent
Thorstensen-Woll

(10) Patent No.: US 10,604,315 B2
(45) Date of Patent: Mar. 31, 2020

(54) DUAL ALUMINUM TAMPER INDICATING TABBED SEALING MEMBER

(71) Applicant: Selig Sealing Products, Inc., Forrest, IL (US)

(72) Inventor: Robert William Thorstensen-Woll, Barrie (CA)

(73) Assignee: Selig Sealing Products, Inc., Forrest, IL (US)

( * ) Notice: Subject to any disclaimer, the term of this patent is extended or adjusted under 35 U.S.C. 154(b) by 687 days.

(21) Appl. No.: 15/107,560

(22) PCT Filed: Feb. 4, 2015

(86) PCT No.: PCT/US2015/014363
§ 371 (c)(1),
(2) Date: Jun. 23, 2016

(87) PCT Pub. No.: WO2015/119988
PCT Pub. Date: Aug. 13, 2015

(65) Prior Publication Data

US 2016/0325896 A1 Nov. 10, 2016

Related U.S. Application Data

(60) Provisional application No. 61/936,218, filed on Feb. 5, 2014.

(51) Int. Cl.
*B65D 55/06* (2006.01)
*B65D 51/20* (2006.01)
(Continued)

(52) U.S. Cl.
CPC ..... *B65D 55/06* (2013.01); *B65D 51/185* (2013.01); *B65D 51/20* (2013.01);
(Continued)

(58) Field of Classification Search
CPC .... B65D 2251/0031; B65D 2251/0034; B65D 2251/009; B65D 2251/0093; B65D 51/185
(Continued)

(56) References Cited

U.S. PATENT DOCUMENTS 1,818,379 A 8/1931 Cain
2,768,762 A 10/1956 Eugene
(Continued)

FOREIGN PATENT DOCUMENTS

AT 501393 A1 8/2006
AT 11738 U1 4/2011
(Continued)

OTHER PUBLICATIONS

Patent Cooperation Treaty, International Search Report and Written Opinion dated May 7, 2015 for International Application No. PCT/US2015/014363, 3 pages.
(Continued)

*Primary Examiner* — Steven A. Reynolds
*Assistant Examiner* — Kaushikkumar A Desai
(74) *Attorney, Agent, or Firm* — Fitch, Even, Tabin & Flannery, LLP

(57) ABSTRACT

A tamper evident tabbed sealing member for sealing to a rim surrounding a container opening is described that includes a multi-layer laminate configured to isolate a residual ring of material that remains on a container land area upon seal removal.

16 Claims, 3 Drawing Sheets

(51) Int. Cl.
*B65D 77/20* (2006.01)
*B65D 51/18* (2006.01)

(52) U.S. Cl.
CPC .... *B65D 77/2056* (2013.01); *B65D 2251/009* (2013.01); *B65D 2251/0015* (2013.01); *B65D 2251/0028* (2013.01); *B65D 2251/0031* (2013.01); *B65D 2251/0093* (2013.01)

(58) Field of Classification Search
USPC ..... 215/232, 258, 305; 220/258.3, 270
See application file for complete search history.

(56) References Cited

U.S. PATENT DOCUMENTS 3,235,165 A 2/1966 Jackson
3,292,828 A 12/1966 Stuart
3,302,818 A 2/1967 Balocca et al.
3,460,310 A 8/1969 Adcock et al.
3,556,816 A 1/1971 Nughes
3,964,670 A 6/1976 Amneus
3,990,603 A 11/1976 Brochman
4,133,796 A 1/1979 Bullman
4,206,165 A 6/1980 Dukess
4,266,687 A 5/1981 Cummings
4,396,655 A 8/1983 Graham
4,556,590 A 12/1985 Martin
4,582,735 A 4/1986 Smith
4,588,099 A 5/1986 Diez
4,595,116 A 6/1986 Carlsson
4,596,338 A 6/1986 Yousif
4,636,273 A 1/1987 Wolfersperger
4,666,052 A 5/1987 Ou-Yang
4,693,390 A 9/1987 Hekal
4,735,335 A 4/1988 Torterotot
4,741,791 A 5/1988 Howard
4,762,246 A 8/1988 Ashley
4,770,325 A 9/1988 Gordon
4,771,903 A 9/1988 Levene
4,781,294 A 11/1988 Croce
4,801,647 A 1/1989 Wolfe, Jr.
4,811,856 A 3/1989 Fischman
4,818,577 A 4/1989 Ou-Yang
4,837,061 A 6/1989 Smits
4,863,061 A 9/1989 Moore
4,867,881 A 9/1989 Kinzer
4,889,731 A 12/1989 Williams
4,934,544 A 6/1990 Han
4,938,390 A 7/1990 Markva
4,960,216 A 10/1990 Giles
4,961,986 A 10/1990 Galda
5,004,111 A 4/1991 McCarthy
5,015,318 A 5/1991 Smits
5,053,457 A 10/1991 Lee
5,055,150 A 10/1991 Rosenfeld
5,057,365 A 10/1991 Finkelstein
5,071,710 A 12/1991 Smits
5,098,495 A 3/1992 Smits
RE33,893 E 4/1992 Elias
5,106,124 A 4/1992 Volkman
5,125,529 A 6/1992 Torterotot
5,131,556 A 7/1992 Iioka
5,149,386 A 9/1992 Smits
5,178,967 A 1/1993 Rosenfeld
5,197,618 A 3/1993 Goth
5,217,790 A 6/1993 Galda
5,226,281 A 7/1993 Han
5,261,990 A 11/1993 Galda
5,265,745 A 11/1993 Pereyra
5,433,992 A 7/1995 Galda
5,513,781 A 5/1996 Ullrich
5,514,442 A 5/1996 Galada et al.
5,560,989 A 10/1996 Han
5,598,940 A 2/1997 Finkelstein
5,601,200 A 2/1997 Finkelstein
5,615,789 A 4/1997 Finkelstein
5,618,618 A 4/1997 Murschall
5,669,521 A 9/1997 Wiening
5,683,774 A * 11/1997 Faykish ..... G03H 1/0011 283/101
5,702,015 A 12/1997 Giles
5,709,310 A 1/1998 Kretz
5,776,284 A 7/1998 Sykes
5,851,333 A 12/1998 Fagnant
5,860,544 A * 1/1999 Brucker ..... B65D 51/20 215/232
5,871,112 A 2/1999 Giles
5,887,747 A 3/1999 Burklin
5,915,577 A 6/1999 Levine
5,975,304 A 11/1999 Cain
5,976,294 A 11/1999 Fagnant
6,056,141 A 5/2000 Navarini
6,082,566 A 7/2000 Yousif
6,096,358 A 8/2000 Murdick
6,131,754 A 10/2000 Smelko
6,139,931 A 10/2000 Finkelstein
6,158,632 A 12/2000 Ekkert
6,194,042 B1 2/2001 Finkelstein
6,290,801 B1 9/2001 Krampe
6,312,776 B1 11/2001 Finkelstein
6,378,715 B1 4/2002 Finkelstein
6,458,302 B1 10/2002 Shifflet
6,461,714 B1 10/2002 Giles
6,544,615 B2 * 4/2003 Otten ..... B65D 5/0236 428/201
6,548,302 B1 4/2003 Mao
6,602,309 B2 8/2003 Vizulis
6,627,273 B2 9/2003 Wolf
6,669,046 B1 12/2003 Sawada
6,699,566 B2 3/2004 Zeiter
6,705,467 B1 3/2004 Kancsar
6,722,272 B2 4/2004 Jud
6,767,425 B2 7/2004 Meier
6,790,508 B2 9/2004 Razeti
6,866,926 B1 * 3/2005 Smelko ..... B32B 5/18 428/319.1
6,902,075 B2 6/2005 OBrien
6,916,516 B1 7/2005 Gerber
6,955,736 B2 10/2005 Rosenberger
6,959,832 B1 11/2005 Sawada
6,974,045 B1 12/2005 Trombach
7,128,210 B2 10/2006 Razeti
7,182,475 B2 2/2007 Kramer
7,217,454 B2 5/2007 Smelko
RE39,790 E 8/2007 Fuchs
7,316,760 B2 1/2008 Nageli
7,448,153 B2 11/2008 Maliner
7,531,228 B2 5/2009 Perre
7,648,764 B2 1/2010 Yousif
7,713,605 B2 5/2010 Yousif
7,740,730 B2 6/2010 Schedl
7,740,927 B2 6/2010 Yousif
7,789,262 B2 9/2010 Niederer
7,798,359 B1 9/2010 Marsella
7,819,266 B2 10/2010 Ross
7,838,109 B2 11/2010 Declerck
7,850,033 B2 12/2010 Thorstensen-Woll
8,025,171 B2 9/2011 Cassol
8,057,896 B2 11/2011 Smelko
8,129,009 B2 3/2012 Morris
8,201,385 B2 6/2012 McLean
8,308,003 B2 11/2012 O'Brien
8,329,288 B2 12/2012 Allegaert
8,348,082 B2 1/2013 Cain
8,715,825 B2 5/2014 Thorstensen-Woll
8,906,185 B2 12/2014 McLean
9,028,963 B2 5/2015 Thorstensen-Woll
9,102,438 B2 8/2015 Thorstensen-Woll
9,193,513 B2 11/2015 Thorstensen-Woll
9,221,579 B2 12/2015 Thorstensen-Woll
9,227,755 B2 1/2016 Thorstensen-Woll
9,440,765 B2 9/2016 Thorstensen-Woll
9,440,768 B2 9/2016 Thorstensen-Woll
9,533,805 B2 1/2017 McLean

(56) References Cited

U.S. PATENT DOCUMENTS

| | | | | |
|---|---|---|---|---|
| 9,676,513 | B2 | 6/2017 | Thorstensen-Woll | |
| 2001/0023870 | A1 | 9/2001 | Mihalov | |
| 2001/0031348 | A1 | 10/2001 | Jud | |
| 2002/0068140 | A1 | 6/2002 | Finkelstein | |
| 2003/0087057 | A1 | 5/2003 | Blemberg | |
| 2003/0168423 | A1 | 9/2003 | Williams | |
| 2003/0196418 | A1 | 10/2003 | O'Brien | |
| 2004/0028851 | A1 | 2/2004 | Okhai | |
| 2004/0043238 | A1 | 3/2004 | Wuest | |
| 2004/0109963 | A1 | 6/2004 | Zaggia | |
| 2004/0197500 | A9 | 10/2004 | Swoboda | |
| 2004/0211320 | A1 | 10/2004 | Cain | |
| 2005/0003155 | A1* | 1/2005 | Huffer | B32B 7/12 428/141 |
| 2005/0048307 | A1 | 3/2005 | Schubert | |
| 2005/0208242 | A1 | 9/2005 | Smelko | |
| 2005/0208244 | A1 | 9/2005 | Delmas | |
| 2005/0218143 | A1 | 10/2005 | Niederer | |
| 2006/0000545 | A1 | 1/2006 | Nageli | |
| 2006/0003120 | A1 | 1/2006 | Nageli | |
| 2006/0003122 | A1 | 1/2006 | Nageli | |
| 2006/0068163 | A1 | 3/2006 | Giles | |
| 2006/0124577 | A1 | 6/2006 | Ross | |
| 2006/0151415 | A1 | 7/2006 | Smelko | |
| 2006/0278665 | A1 | 12/2006 | Bennett | |
| 2007/0003725 | A1 | 1/2007 | Yousif | |
| 2007/0007229 | A1 | 1/2007 | Yousif | |
| 2007/0065609 | A1* | 3/2007 | Korson | B65D 55/026 428/34.1 |
| 2007/0267304 | A1 | 11/2007 | Portier | |
| 2007/0298273 | A1 | 12/2007 | Thies | |
| 2008/0026171 | A1 | 1/2008 | Gullick | |
| 2008/0073308 | A1 | 3/2008 | Yousif | |
| 2008/0103262 | A1 | 5/2008 | Haschke | |
| 2008/0145581 | A1 | 6/2008 | Tanny | |
| 2008/0156443 | A1 | 7/2008 | Schaefer | |
| 2008/0169286 | A1 | 7/2008 | McLean | |
| 2008/0231922 | A1 | 9/2008 | Thorstensen-Woll | |
| 2008/0233339 | A1 | 9/2008 | Thorstensen-Woll | |
| 2008/0233424 | A1* | 9/2008 | Thorstensen-Woll | B32B 7/06 428/621 |
| 2009/0078671 | A1 | 3/2009 | Triquet | |
| 2009/0208729 | A1 | 8/2009 | Allegaert | |
| 2009/0304964 | A1 | 12/2009 | Sachs | |
| 2010/0009162 | A1 | 1/2010 | Rothweiler | |
| 2010/0030180 | A1 | 2/2010 | Deckerck | |
| 2010/0047552 | A1 | 2/2010 | McLean | |
| 2010/0059942 | A1 | 3/2010 | Rothweiler | |
| 2010/0116410 | A1 | 5/2010 | Yousif | |
| 2010/0155288 | A1 | 6/2010 | Harper | |
| 2010/0170820 | A1 | 7/2010 | Leplatois | |
| 2010/0193463 | A1* | 8/2010 | O'Brien | B32B 5/32 215/232 |
| 2010/0213193 | A1 | 8/2010 | Helmlinger | |
| 2010/0221483 | A1 | 9/2010 | Gonzalez Carro | |
| 2010/0290663 | A1 | 11/2010 | Trassl | |
| 2010/0314278 | A1* | 12/2010 | Fonteyne | B32B 7/05 206/469 |
| 2011/0000917 | A1 | 1/2011 | Wolters | |
| 2011/0005961 | A1 | 1/2011 | Leplatois | |
| 2011/0089177 | A1 | 4/2011 | Thorstensen-Woll | |
| 2011/0091715 | A1 | 4/2011 | Rakutt | |
| 2011/0100949 | A1 | 5/2011 | Grayer | |
| 2011/0100989 | A1 | 5/2011 | Cain | |
| 2011/0138742 | A1 | 6/2011 | McLean | |
| 2011/0147353 | A1 | 6/2011 | Kornfeld | |
| 2011/0152821 | A1 | 6/2011 | Kornfeld | |
| 2012/0000910 | A1 | 1/2012 | Ekkert | |
| 2012/0043330 | A1 | 2/2012 | McLean | |
| 2012/0067896 | A1* | 3/2012 | Daffner | B65D 77/2056 220/359.3 |
| 2012/0070636 | A1 | 3/2012 | Thorstensen-Woll | |
| 2012/0103988 | A1 | 5/2012 | Wiening | |
| 2012/0111758 | A1* | 5/2012 | Lo | B65D 51/22 206/524.6 |
| 2012/0241449 | A1 | 9/2012 | Frischmann | |
| 2012/0285920 | A1 | 11/2012 | McLean | |
| 2012/0312818 | A1 | 12/2012 | Ekkert | |
| 2013/0020324 | A1* | 1/2013 | Thorstensen-Woll | B32B 7/06 220/270 |
| 2013/0020328 | A1 | 1/2013 | Duan | |
| 2013/0121623 | A1 | 5/2013 | Lyzenga | |
| 2013/0177263 | A1 | 7/2013 | Duan | |
| 2014/0001185 | A1 | 1/2014 | McLean | |
| 2014/0061196 | A1 | 3/2014 | Thorstensen-Woll | |
| 2014/0061197 | A1 | 3/2014 | Thorstensen-Woll | |
| 2014/0186589 | A1 | 7/2014 | Chang | |
| 2014/0224800 | A1 | 8/2014 | Thorstensen-Woll | |
| 2015/0053680 | A1 | 2/2015 | Yuno | |
| 2015/0197385 | A1 | 7/2015 | Wei | |
| 2015/0225116 | A1 | 8/2015 | Thorstensen-Woll | |
| 2015/0321808 | A1 | 11/2015 | Thorstensen-Woll | |
| 2016/0185485 | A1 | 6/2016 | Thorstensen-Woll | |
| 2017/0253373 | A1 | 9/2017 | Thorstensen-Woll | |

FOREIGN PATENT DOCUMENTS

| | | | |
|---|---|---|---|
| BR | 8200231 | U | 9/2003 |
| BR | 0300992 | A | 11/2004 |
| CA | 2015992 | A1 | 1/1991 |
| CA | 2203744 | | 10/1997 |
| CA | 2297840 | A1 | 2/1999 |
| CN | 1301289 | A | 6/2001 |
| DE | 102006030118 | B3 | 5/2007 |
| DE | 10204281 | A1 | 8/2007 |
| DE | 102007022935 | B4 | 4/2009 |
| DE | 202009000245 | U1 | 4/2009 |
| EP | 0135431 | | 3/1985 |
| EP | 0668221 | A1 | 8/1995 |
| EP | 0826598 | A2 | 3/1998 |
| EP | 0826599 | A2 | 3/1998 |
| EP | 0905039 | A1 | 3/1999 |
| EP | 0717710 | B1 | 4/1999 |
| EP | 0915026 | A1 | 5/1999 |
| EP | 0706473 | B1 | 8/1999 |
| EP | 1075921 | | 2/2001 |
| EP | 0803445 | B1 | 11/2003 |
| EP | 1462381 | A1 | 9/2004 |
| EP | 1199253 | B1 | 3/2005 |
| EP | 1577226 | A1 | 9/2005 |
| EP | 1814744 | A1 | 8/2007 |
| EP | 1834893 | A1 | 9/2007 |
| EP | 1837288 | A1 | 9/2007 |
| EP | 1839898 | A1 | 10/2007 |
| EP | 1839899 | A1 | 10/2007 |
| EP | 1857275 | A1 | 11/2007 |
| EP | 1873078 | A1 | 1/2008 |
| EP | 1445209 | B1 | 5/2008 |
| EP | 1918094 | A1 | 5/2008 |
| EP | 1935636 | | 6/2008 |
| EP | 1968020 | A1 | 9/2008 |
| EP | 1992476 | A1 | 11/2008 |
| EP | 2014461 | | 1/2009 |
| EP | 2230190 | A1 | 9/2010 |
| EP | 2292524 | A1 | 3/2011 |
| EP | 2599735 | | 6/2013 |
| FR | 2916157 | A1 | 11/2008 |
| FR | 2943322 | A1 | 9/2010 |
| GB | 1216991 | | 12/1970 |
| GB | 2353986 | | 3/2001 |
| GB | 2501967 | | 11/2013 |
| GB | 2501967 | A | 11/2013 |
| JP | H09110077 | | 4/1997 |
| JP | H09110077 | A | 4/1997 |
| KR | 100711073 | B1 | 4/2007 |
| KR | 100840926 | B1 | 6/2008 |
| KR | 100886955 | B1 | 3/2009 |
| MX | 05002905 | A | 2/2006 |
| MX | 2010001867 | A | 4/2010 |
| TW | 201217237 | A | 5/2012 |
| WO | 9905041 | A1 | 2/1999 |
| WO | 2000066450 | | 11/2000 |

(56) References Cited

FOREIGN PATENT DOCUMENTS

| | | | |
|---|---|---|---|
| WO | 2005009868 | | 2/2005 |
| WO | 2006018556 | A1 | 2/2006 |
| WO | 2006021291 | A1 | 3/2006 |
| WO | 2006073777 | A1 | 7/2006 |
| WO | 2006108853 | A1 | 10/2006 |
| WO | 2008027029 | A2 | 3/2008 |
| WO | 2008027036 | A1 | 3/2008 |
| WO | 2008039350 | A2 | 4/2008 |
| WO | 2008118569 | A2 | 10/2008 |
| WO | 2008125784 | A1 | 10/2008 |
| WO | 2008125785 | A1 | 10/2008 |
| WO | 2008148176 | A1 | 12/2008 |
| WO | 2009092066 | A2 | 7/2009 |
| WO | 2010115811 | A1 | 10/2010 |
| WO | 2011039067 | A1 | 4/2011 |
| WO | 2012079971 | A1 | 6/2012 |
| WO | 2012113530 | A1 | 8/2012 |
| WO | 2012152622 | A1 | 11/2012 |
| WO | 2012172029 | A1 | 12/2012 |
| WO | 2015119988 | | 8/2015 |

OTHER PUBLICATIONS

European Patent Office, Communication Pursuant to Article 94(3) EPC dated Jan. 23, 2019, Examination Report for European Patent Application No. 15 746 686.3, 7 pages.

* cited by examiner

DUAL ALUMINUM TAMPER INDICATING TABBED SEALING MEMBER

CROSS-REFERENCE TO RELATED APPLICATION

This application is a U.S. national phase application filed under 35 U.S.C. § 371 of International Application Number PCT/US2015/014363, filed Feb. 4, 2015, designating the United States, which claims benefit of U.S. Provisional Application No. 61/936,218, filed Feb. 5, 2014, which are hereby incorporated herein by reference in their entirety.

FIELD

The disclosure relates to sealing members for use as secondary closures on containers, and more particularly, to tamper indicating tabbed sealing members.

BACKGROUND

It is often desirable to seal the opening of a container using a removable or peelable seal, sealing member, or inner seal. Often a cap or other closure is then screwed or placed over the container opening capturing the sealing member therein. In use, a consumer typically removes the cap or other closure to gain access to the sealing member and then removes or otherwise peels the seal from the container in order to dispense or gain access to its contents.

In some cases, the inner seal provides tamper evidence whereby a portion of the seal remains on the container as evidence that the sealing member has been removed or tampered with. For instance, upon removal of the sealing member from the container, the laminate forming the sealing member is designed to rupture and leave debris on the container finish to indicate that the package has been opened. Prior examples of such tamper evidence tabbed liners resulted in a laminates that left debris on the container directly dependent on the placement of the tab. For example, if the tab was on the top of the sealing member and defined wholly within its perimeter and covering approximately 50 percent of the seal, then prior seats generally left debris on the container land area and also covering over approximately 50 percent of the container opening. The consumer would then need to remove this remaining seal portion in order to effectively use the container, which tended to serve as a nuisance to some consumers and in some applications.

DETAILED DESCRIPTION

Figure 1:
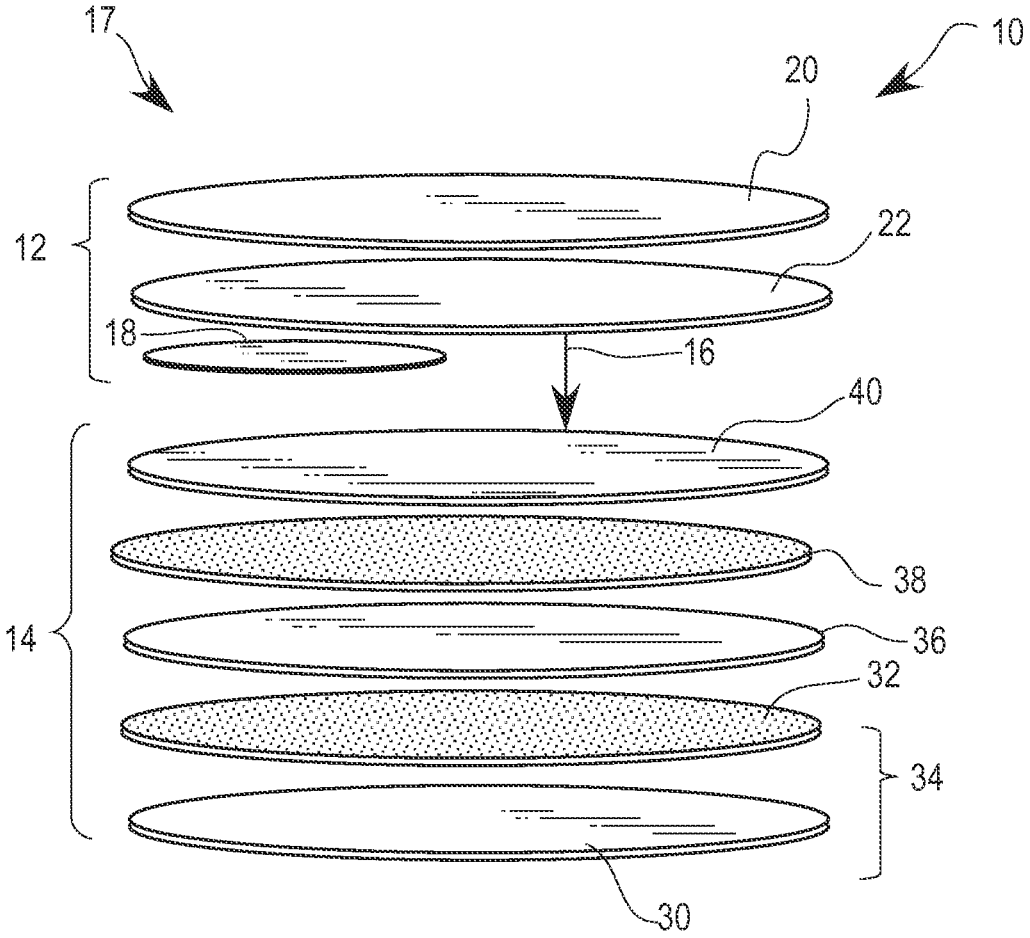
FIG. 1 is an exploded cross-section view of an exemplary tabbed sealing member of the disclosure.

The present disclosure generally relates to tabbed sealing members having a gripping tab defined wholly within a perimeter of the seal that is also configured to provide tamper evidence. The sealing members herein eliminate the excessive debris left by prior tamper evidence top-tabbed type inner seals. In one aspect, the sealing members herein are arranged and configured to isolate the residual debris, after removal of the sealing member from the container via the tab, to the land region of the container rim independent of the size or positioning of the tab on the top surface of the sealing member. In another aspect, the tabbed sealing members herein utilize a unique dual foil assembly or dual layered aluminum assembly to aid in achieving the isolated debris left as a ring of sealant and single aluminum layer on the container rim.

In a preferred approach, a dual layered aluminum sealant component or laminate is configured upon removal from the container to leave a residue of sealant and aluminum remnants isolated to the container finish, which controls the amount of residual liner remaining on the container after opening. Preferably, the isolated remnants are a thin annular ring of the sealant and aluminum layers. Reducing the land areas and also stepping in the container finish help to reduce the removal force of this design. That is, the top surface area of the container rim land area may be reduced. The separation functionality is controlled by the gauge of the aluminum in the base layer and the selection of the adhesive between the two layers.

By one approach, the tabbed seating member includes the lamination of a base foil layer and sealant component that is bonded to a secondary foil component to form a tamper evidence substructure. The bonding may be by extrusion lamination or thermal lamination. Optional layers may then be applied to the tamper evidence substructure, such as foam layers, non-foam polymer layers, and various tab components to form a tamper evidence sealing member configured to isolate the residual debris to the container rim. This laminate can be used as a single element liner system or within a two-piece assembly where the sealing member is temporarily bonded (such as by wax) to a pulp or synthetic backing material in a so-called two-piece seal and liner configuration.

For simplicity, this disclosure generally may refer to a container or bottle, but the sealing members herein may be applied to any type of container, bottle, package or other apparatus having a rim or mouth surrounding an access opening to an internal cavity. In this disclosure, reference to upper and lower surfaces and layers of the components of the sealing member refers to an orientation of the components as generally depicted in figures and when the sealing member is in use with a container in an upright position and having an opening at the top of the container. Different approaches to the sealing member will first be generally described, and then more specifics of the various constructions and materials will be explained thereafter. It will be appreciated that the sealing members described herein, in some cases, function in both a one-piece or two-piece sealing member configuration. A one-piece sealing member generally includes just the seating member bonded to a container rim. A cap or closure may be also used therewith. A two-piece sealing member includes the sealing member temporarily bonded to a liner. In this construction, the sealing member is bonded to a container's rim, and the liner is configured to separate from the sealing member during heating to be retained in a cap or other closure used on the container. In a two-piece construction, a wax layer, for example, may be used to temporarily bond the seating member to a liner. Other types of releasable layers may also be used to provide a temporary bond between the seal and liner, but the releasable layers are generally heat activated.

Turning to FIG. 1, one example of a tamper evidence tabbed sealing member 10 is shown. Seat 10 includes an upper laminate 12 partially bonded to a lower laminate 14 via a partial bond 16 to form a gripping tab 17 defined wholly within a perimeter of the seal. In this approach, the seal also includes a partial layer or tab stock 18 to aid in forming the tab 17. The tab stock 18 is bonded to layers in the upper laminate 12 but not bonded to layers in the lower laminate 14.

The upper laminate 12 may also include a polymer film support layer 20 to provide structural support and a co-polymer layer or bonding layer 22 to bond the polymer film 20 to the lower laminate 14. Here, the film 20 is partially bonded to the tab stock 18 and partially bonded to the lower laminate via the bonding layer 22.

Support film layer 20 may be may be polyethylene terephthalate (PET), nylon, polyolefin, or other structural polymer layer and may be, in some approaches, about 0.5 to about 2.5 mil thick.

When using the tab stock 18, the tab 17 is defined or formed via the tab stock 18 that extends only part way across the upper laminate 12. More specifically, the tab stock 18 forms the tab 17 because it bonds to the bonding layer 22 and generally prevents layer 20 (and any layers above) from adhering to the upper surface of the lower seal laminate 14 (or any layers therebetween) across at least a portion thereof. A bottom surface of tab stock 18 is adjacent to, but not bonded to, the upper surface of the tower laminate 14 to form the tab 17. In one aspect, the tab stock 18 is formed of polyester, such as polyethylene terephthalate (PET), or paper. By one optional approach, a lower surface of the tab stock 18 may be coated with a release material, for example silicone. The optional release coating minimizes the possibility that the tab stock 18 will become adhered to the upper surface of the lower laminate 14 during the heat seating or induction heat sealing process. The tab stock 18 permits the tab structure 17 to pivot or hinge upwardly along a boundary line to form the tab 17. By this approach, the tab stock 18 and formed tab 17 are defined wholly within a circumference or perimeter of the seal.

The bonding layer 22 may include any polymer materials that adhesively bond, are heat activated, or heated to achieve its bonding characteristics or application to the seal. By one approach, the bonding layer 22 may be selected form ethylene vinyl acetate (EVA), polyolefin, 2-component polyurethane, ethylene acrylic acid copolymers, curable two-part urethane adhesives, epoxy adhesives, ethylene methacrylate copolymers and the like bonding materials. As shown, the heat activated bonding layer 22 extends the full width of the laminate segment 12. In other approaches, the laminate 12 may only include a partial layer of adhesive and, thus, not use the tab stock layer 18 discussed above.

By one approach, the bonding layer 22 is EVA with a vinyl acetate content of about 20 to about 28 percent with the remaining monomer being ethylene in order to achieve the bond strengths to securely hold the upper laminate to the lower laminate. In some cases, a vinyl acetate content lower than 20 percent is insufficient to form the robust structures described herein. By one approach, bonding layer 22 may be about 0.5 to about 3.5 mil of EVA, in other approaches about 0.5 to about 2.5 mils of EVA, in other approaches, about 0.5 to about 1.5 mils of EVA and, in yet other approaches, about 0.5 to about 1.0 mils of EVA; however, the thickness can vary as needed for a particular application to achieve the desired bonds and internal strength.

The lower laminate 14 forms the tamper evidence substructure of the unique tamper evident sealing member 10. This substructure includes a lower sealant or heat seal layer 30 that may be composed of any material suitable for bonding to the rim of a container, such as but not limited to induction, conduction, or direct bonding methods. Suitable adhesives, hot melt adhesives, or sealants for the heat sealable layer 30 include, but are not limited to, polyesters, polyolefins, ethylene vinyl acetate, ethylene-acrylic acid copolymers, surlyn ionomers and other suitable materials. By one approach, the heat sealable layer may be a single layer or a multi-layer structure of such materials about 0.2 to about 3 mils thick. By some approaches, the heat seal layer is selected to have a composition similar to and/or include the same polymer type as the composition of the container. For instance, if the container includes polyethylene, then the heat seal layer would also contain polyethylene. If the container includes polypropylene, then the heat seal layer would also contain polypropylene. Other similar materials combinations are also possible. By one approach, the seal layer 30 is about 1 to about 2 mils thick or, in some approaches, about 1.5 mil thick medium density polyethylene film (in some cases about 0.92 to about 0.94 g/cm, but may be other density as needed).

Next, the lower laminate includes a first, base, or primary membrane layer 32. The base membrane layer 32 may be one or more layers configured to provide induction heating and/or barrier characteristics to the seal 10. A layer configured to provide induction heating is any layer capable of generating heat upon being exposed to an induction current where eddy currents in the layer generate heat. By one approach, the membrane layer may be a metal layer, such as, aluminum foil, tin, and the like. In other approaches, the membrane layer may be a polymer layer in combination with an induction heating layer. The membrane layer may also be or include an atmospheric barrier layer capable of retarding the migration of gases and moisture at least from outside to inside a sealed container and, in some cases, also provide induction heating at the same time. Thus, the membrane layer may be one or more layers configured to provide such functionalities. By one approach, the membrane layer is about 0.3 to about 2 mils of a metal foil, such as aluminum foil, which is capable of providing induction heating and to function as an atmospheric barrier. In one particular approach, the member layer 32 is a 1 mil thick aluminum foil. There is some advantage in reducing the gauge of the aluminum component in the base foil laminate or substructure. Thinner aluminum foil is easier to break and the use of thinner foil reduces the force required by the consumer to peel the liner form the container. In some approaches, the foil layer 32 is thinner than the lower heat seal layer. The combination of the seal layer 30 and base foil layer 32 forms a substructure composite laminate 34.

Next, the sealing member includes a bonding layer 36 (or hot melt adhesive) above the base foil layer 32. The correct separation of the sealing member to isolate the residue to the container land area is generally dependent on the selection of this bonding layer 36. Thickness of this layer also helps achieve the unique functionality of the seals herein. The hot melt layer may have a thickness from about 1 to about 3 mils. Layer 36 needs to maintain lamination integrity to hold the seal component together, but also remain soft enough to peel away from the foil 32 above the container land area during seal removal by a consumer. Suitable examples of materials for the bonding layer 36 include co-extruded polyethylene/EVA sealants having a high vinyl acetate composition (such as about 20 to about 40 percent). Other suitable materials for the bonding layer 36 may include EVA hot melts, EAA coatings, or PET heat seal films. In one particular form, the bonding layer 36 is EVA-based hot melt.

Above the bonding layer 36 there is a secondary foil component 38 and an upper polymer support component 40. The secondary foil component 38 may be similar to the base or primary foil (that is about 0.3 to about 2 mils thick), but in some approaches, may be equal to or thinner than the base foil component 32. The upper polymer support component 40 may be films, foams, or other support materials. For instance, component 40 may be a polymer foam or a non-foamed polymer film, such as polyolefin, polyester films or foams.

Layer 40 may be an insulation layer or a heat-redistribution layer. In one form, layer 106 may be a foamed polymer layer. Suitable foamed polymers include foamed polyolefin, foamed polypropylene, foamed polyethylene, and polyester foams. In some forms, these foams generally have an internal rupture strength of about 2000 to about 3500 g/in. In some approaches, the foamed polymer layer 106 may also have a density less than 0.6 g/cc and, in some cases, about 0.4 to less than about 0.6 g/cc. In other approaches, the density may be from about 0.4 g/cc to about 0.9 g/cc. The foamed polymer layer may be about 1 to about 5 mils thick.

In some approaches, a ratio of the base foil to the secondary foil may be about 1:1 to about 5:1. In other approaches, the break-in or rupture force of the seal layers that remain on the container is proportional to the sealant areas available on the container land region of the container.

Figure 2:
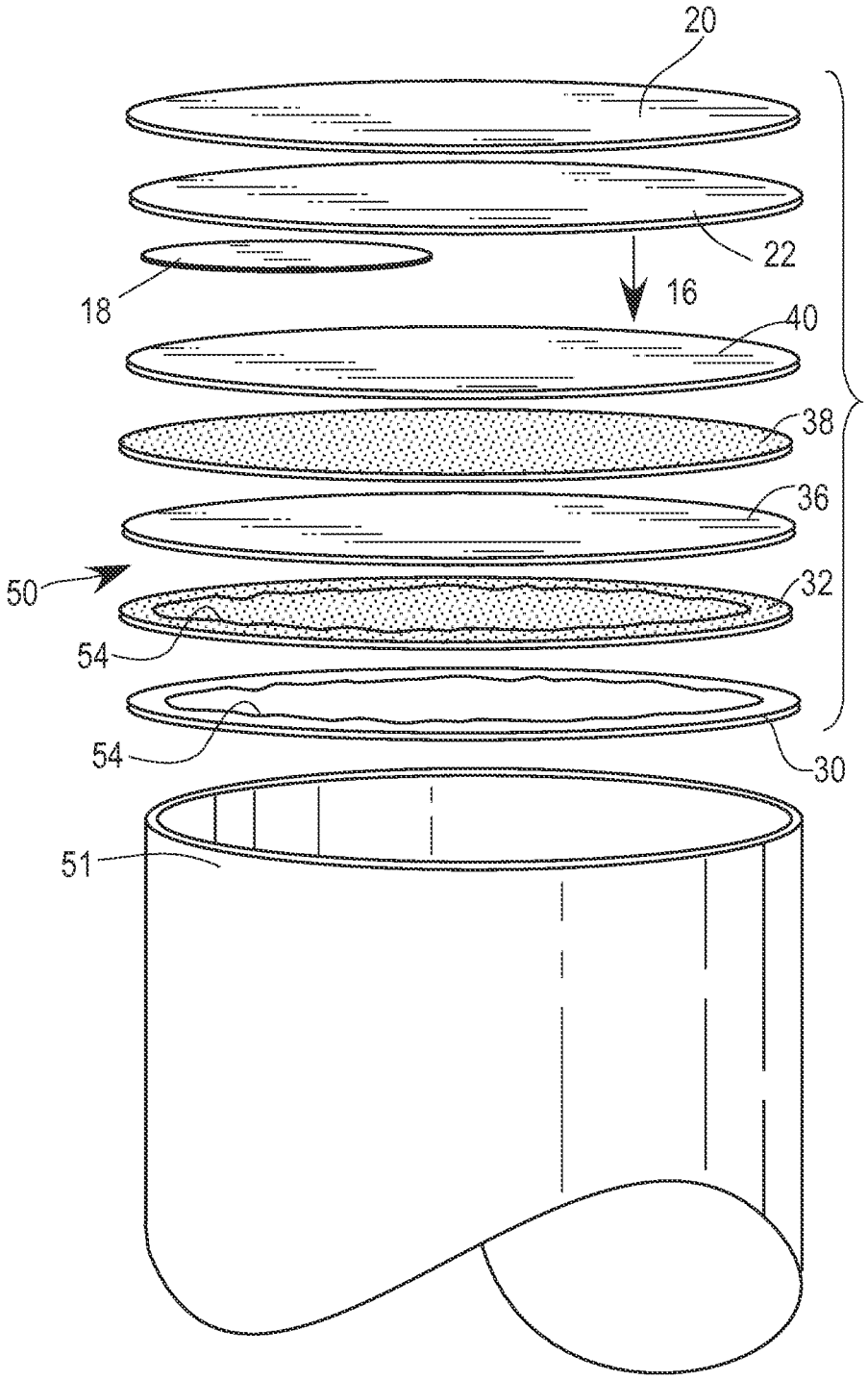
FIG. 2 is another exploded cross-section view of an exemplary tabbed sealing member of the disclosure.

FIG. 2 shows an alternative embodiment of the tabbed sealing members herein. Various layers in FIG. 2 are similar to FIG. 1 and will not be described further. Some of the layers in FIG. 2 may be different in thickness such as a lower foil layer that is 0.5 mils or less, but can be the same as that described above.

Figure 3:
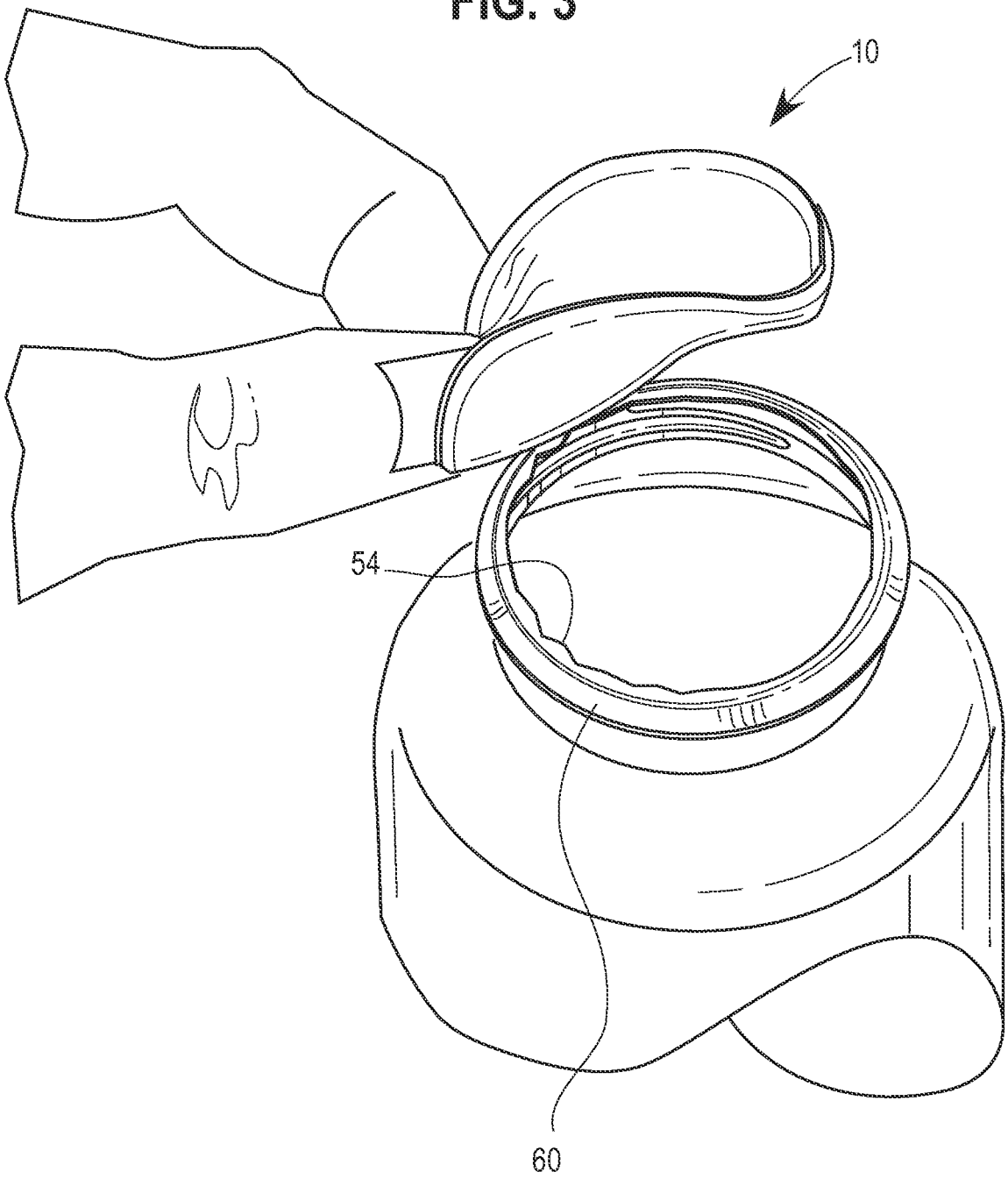
FIG. 3 is an image of the tabbed sealing member of the disclosure shown removed from a container with residual material left on the container rim land area.

FIG. 2 also shows the where the laminate ruptures upon sealing member removal to isolate the residue on the container land area. The laminate separates at 50 where the bonding layer 36 peels away from the base foil layer 32 above the container rim land area (Generally shown as 51). Then, the base foil 32 and lower sealant 30 rupture internally 54 along the inner edges of the container rim all around the rim. This separation isolates the sealing member residue 60 as a ring of material on the container rim as best shown in the image of FIG. 3.

In some approaches, there is a small overhang or annular flange of the sealing member extending beyond the container rim when sealed to the container rim. In some approaches, this overhang may be about 1 to about 3 mm. In other approaches, the container finish may be stepped inwardly so that the upper land area is reduced forming the overhang of material. This overhang of material is generally illustrated in FIG. 3.

In some approaches, the following features define the sealing members herein. The various features and limitations of the sealing members described above, in the figures, and discussed below are not exclusive to the mentioned sealing member, but may be included in any combination thereof. Mention of an aspect or embodiment of the seals or container herein is not intended to imply that such aspect or embodiment is mutually exclusive of all other aspects or embodiments. In other words, the various features as set forth herein may be united in various combinations as needed for a particular application and features in one paragraph may be combined with features in other paragraphs as needed.

In one form, embodiment, or version, a tamper evident tabbed sealing member for sealing to a rim surrounding a container opening is provided that includes dual foil layers. This sealing member may include a multi-layer laminate with an upper laminate portion partially bonded to a tamper evident lower laminate substructure to form a gripping tab in the upper laminate portion defined wholly within a perimeter of the sealing member. The gripping tab for removing the sealing member from a container opening. The tamper evident lower laminate substructure below the gripping tab including at least a heat seal layer for bonding to the container rim, a primary metal layer positioned for heating the heat seal layer, a bonding layer above the primary metal layer, a secondary metal layer above the bonding layer, and an upper polymer support layer; and upon the seating member removal from a container, the primary metal layer and the heat seal layer separate from the bonding layer to isolate a residual ring of material that remains on the container land area.

The tamper evident tabbed sealing member above may also include the isolated residual ring of material being independent of the size or positioning of the tab, wherein the upper polymer support layer is a polyolefin film or polyolefin foam layer or a multi-layer laminate including both film and foam components, wherein the heat seal layer is polyester, polyolefin, ethylene vinyl acetate, ethylene-acrylic acid copolymers, inomers, medium density polyethylene, and combinations thereof, wherein the lower heat seal layer is about 0.2 to about 3 mils thick, wherein the primary metal layer is thinner than the heat seal layer, wherein the primary metal layer is about 0.3 to about 2 mils thick, wherein a bond of the bonding layer to the primary metal layer is less than a bond of the bonding layer to the upper polymer support layer in at least the portions above the container rim land area, further comprising a partial layer tabstock forming the tab due to the tabstock bonded to the upper laminate but not bonded to the tamper evident lower laminate substructure below the tabstock, and/or any combinations of the above features.

In form, embodiment, or versions, a sealed container is described with a dual foil layer tamper evidence tabbed sealing member. This sealing container may include a container defined by a wall and having an inwardly stepped finish with an upper land area surrounding a container opening, the upper land area of the inwardly stepped finish is thinner than the container wall. The container may also include a tamper evident tabbed sealing member sealed to the upper land area rim, the tamper evident tabbed sealing member including a multi-layer laminate including an upper laminate portion partially bonded to a tamper evident lower laminate substructure to form a gripping tab in the upper laminate portion defined wholly within a perimeter of the sealing member, the gripping tab for removing the seating member from a container opening; and the tamper evident lower laminate substructure below the gripping tab including at least a heat seal layer for bonding to the container rim, a primary metal layer positioned for heating the heat seal layer, a bonding layer above the primary metal layer, a secondary metal layer above the bonding layer, and an upper polymer support layer. Upon the sealing member removal from a container, the primary metal layer and the heat seal layer separate from the bonding layer to isolate a residual ring of material that remains on the container land area.

The container of claim may also include the isolated residual ring of material being independent of the size or positioning of the tab, wherein the upper polymer support layer is a polyolefin film or polyolefin foam layer or a multi-layer laminate including both film and foam components, wherein the heat seal layer is polyester, polyolefin, ethylene vinyl acetate, ethylene-acrylic acid copolymers, inomers, medium density polyethylene, and combinations thereof, wherein the lower heat seal layer is about 0.2 to about 3 mils thick, wherein the primary metal layer is thinner than the heat seal layer, wherein the primary metal layer is about 0.3 to about 2 mils thick, wherein a bond of the bonding layer to the primary metal layer is less than a bond of the bonding layer to the upper polymer support layer in at least the portions above the container rim land area. The sealed container may also include the tabstock as mentioned above.

It will be understood that various changes in the details, materials, and arrangements of the process, liner, seal, and combinations thereof, which have been herein described and illustrated in order to explain the nature of the products and methods may be made by those skilled in the art within the principle and scope of the embodied product as expressed in the appended claims. For example, the seals may include other layers within the laminate and between the various layers shown and described as needed for a particular application. Adhesive layers not shown in the Figures may also be used, if needed, to secure various layers together. Unless otherwise stated herein, all parts and percentages are by weight.

What is claimed is:

1. A tamper evident tabbed sealing member for sealing to a rim surrounding a container opening including dual foil layers, the sealing member comprising:

a multi-layer laminate including an upper laminate portion partially bonded to a tamper evident lower laminate substructure to form a gripping tab in the upper laminate portion defined wholly within a perimeter of the sealing member, the gripping tab for removing the sealing member from a container opening;

the tamper evident lower laminate substructure below the gripping tab including at least a heat seal layer for bonding to the container rim, a primary metal layer positioned for heating the heat seal layer, a bonding layer above the primary metal layer, a secondary metal layer above the bonding layer, and an upper polymer support layer, wherein a bond of the bonding layer to the primary metal layer is less than a bond of the bonding layer to the upper polymer support layer in at least peripheral edge portions; and upon the sealing member removal from a container, a ring of the primary metal layer and the heat seal layer separate from the bonding layer to isolate a residual ring of the primary metal layer and of the heat seal layer that remains on the container land area.

2. The tamper evident tabbed sealing member of claim 1, wherein the isolated residual ring of material is independent of the size or positioning of the tab.

3. The tamper evident tabbed sealing member of claim 1, wherein the upper polymer support layer is a polyolefin film or polyolefin foam layer or a multi-layer laminate including both film and foam components.

4. The tamper evident tabbed sealing member of claim 1, wherein the heat seal layer is polyester, polyolefin, ethylene vinyl acetate, ethylene-acrylic acid copolymers, inomers, medium density polyethylene, and combinations thereof.

5. The tamper evident tabbed sealing member of claim 1, wherein the lower heat seal layer is about 0.2 to about 3 mils thick.

6. The tamper evident tabbed sealing member of claim 1, wherein the primary metal layer is thinner than the heat seal layer.

7. The tamper evident tabbed sealing member of claim 1, wherein the primary metal layer is about 0.3 to about 2 mils thick.

8. The tamper evident tabbed sealing member of claim 1, further comprising a partial layer tabstock forming the tab due to the tabstock bonded to the upper laminate but not bonded to the tamper evident lower laminate substructure below the tabstock.

9. A tamper evident tabbed sealing member for sealing to a rim surrounding a container opening, the sealing member comprising:

a multi-layer laminate including an upper laminate portion partially bonded to a tamper evident lower laminate substructure to form a gripping tab defined wholly within a perimeter of the sealing member, the gripping tab for removing the sealing member from a container opening;

the tamper evident lower laminate substructure below the gripping tab including at least a lowermost heat seal layer, a primary metal layer positioned for heating the heat seal layer, a bonding layer above the primary metal layer, a secondary metal layer above the bonding layer, and an upper polymer support layer; and wherein the tamper evident tabbed sealing member is configured to separate the primary metal layer and the heat seal layer from the bonding layer at a peripheral edge of the tabbed sealing member so as to form a residual ring of material separate from a remainder of the tamper evident tabbed sealing member.

10. A sealed container comprising:

a container defined by a wall and having an inwardly stepped finish with an upper land area surrounding a container opening, the upper land area of the inwardly stepped finish is thinner than the container wall;

a tamper evident tabbed sealing member sealed to the upper land area rim, the tamper evident tabbed sealing member including a multi-layer laminate including an upper laminate portion partially bonded to a tamper evident lower laminate substructure to form a gripping tab in the upper laminate portion defined wholly within a perimeter of the sealing member, the gripping tab for removing the sealing member from a container opening; and the tamper evident lower laminate substructure below the gripping tab including at least a heat seal layer for bonding to the container rim, a primary metal layer positioned for heating the heat seal layer, a bonding layer above the primary metal layer, a secondary metal layer above the bonding layer, and an upper polymer support layer, wherein a bond of the bonding layer to the primary metal layer is less than a bond of the bonding layer to the upper polymer support layer in at least the portions above the container rim land area; and wherein upon the sealing member removal from the container, a ring of the primary metal layer and the heat seal layer separate from the bonding layer to isolate a residual ring of the primary metal layer and of the heat seal layer that remains on the container land area.

11. The container of claim 10, wherein the isolated residual ring of material is independent of the size or positioning of the tab.

12. The container of claim 10, wherein the upper polymer support layer is a polyolefin film or polyolefin foam layer or a multi-layer laminate including both film and foam components.

13. The container of claim 10, wherein the heat seal layer is polyester, polyolefin, ethylene vinyl acetate, ethylene-acrylic acid copolymers, inomers, medium density polyethylene, and combinations thereof.

14. The container of claim 10, wherein the lower heat seal layer is about 0.2 to about 3 mils thick.

15. The container of claim 10, wherein the primary metal layer is thinner than the heat seal layer.

16. The container of claim 10, wherein the primary metal layer is about 0.3 to about 2 mils thick.

* * * * *